United States Patent [19]

Mustafa

[11] Patent Number: 4,934,575

[45] Date of Patent: Jun. 19, 1990

[54] MULTIPLE ROLL DISPENSER

[76] Inventor: Shefqet Mustafa, 104 Nanport Street, Brampton, Ontario, Canada, L6S 4A9

[21] Appl. No.: 225,795

[22] Filed: Jul. 29, 1988

[51] Int. Cl.[5] ..... B26F 3/02; B65H 16/08

[52] U.S. Cl. ..... 225/38; 225/42; 225/46

[58] Field of Search ..... 225/35–38, 225/42, 43, 46, 47, 53; 83/650; 242/55.3, 55.53

[56] References Cited

U.S. PATENT DOCUMENTS

| | | | |
|---|---|---|---|
| 804,702 | 1/1907 | Maloney | 83/650 |
| 2,456,660 | 12/1948 | Werner | 225/35 |
| 2,722,387 | 11/1955 | Tuttle | 225/43 |
| 2,969,169 | 1/1961 | Botnick | 225/38 |
| 3,373,644 | 3/1968 | Bjelland | 83/650 |
| 4,492,138 | 1/1985 | Breuers et al. | 83/650 |
| 4,557,426 | 12/1985 | Siciliano | 225/34 |

FOREIGN PATENT DOCUMENTS

| | | | |
|---|---|---|---|
| 22199 | 11/1905 | Austria | 225/35 |
| 339789 | 4/1936 | Italy | 225/38 |

*Primary Examiner*—Hien H. Phan

*Attorney, Agent, or Firm*—Ridout & Maybee

[57] ABSTRACT

A dispenser for multiple rolls of sheet material has a housing with a pair of end body portions held in spaced relationship by longitudinal bracing members, and hubs on the end body portions for retaining the rolls. The hubs are aligned in pairs about the axis and each pair is adapted to receive and rotatably support a roll of sheet material. The dispenser has a semi-cylindrical cover for each pair of hubs with each cover having a cutting edge and bearings adapted for engaging with the pair of hubs to support the cover so that the cover is rotatable from an open position in which the pair of hubs are exposed to a closed position covering the pair of hubs. The dispenser has brackets which rotatably support the housing. One of the brackets and the housing are connected by spring loaded manually operable locking means so that the housing can be rotated to and then locked in a position allowing removal of sheet material.

10 Claims, 4 Drawing Sheets

MULTIPLE ROLL DISPENSER

This invention relates to a dispenser for rolls of sheet material and in particular a dispenser carrying a multiplicity of such rolls. In general, the rolls have a tubular base upon which sheet material selected from waxed paper, aluminum foil, plastic wrap, and the like is rolled.

The most common conventional dispenser for rolled sheet material comprises two support brackets which are spaced from one another approximately the length of the roll. Each bracket has a hub positioned adjacent its distal end lacing the other bracket. Conventionally, one hub may include biasing means allowing it to be pushed toward the bracket to which it is attached. In use, the biased hub is pushed towards its bracket, a roll of sheet material positioned between the hubs, and the biased hub released so that the hubs engage in the axial bore of each roll. The roll is able to rotate on the hubs and therefore the sheet material may be pulled from the roll as needed.

These conventional dispensers are perfectly adequate when the sheet material has weakened tear lines and when only one roll of sheet material is required. If the sheet material on the roll does not have tear lines, it is difficult to tear off conveniently sized portions of the sheet. Also, because the dispenser can hold only one roll, a separate dispenser is required for each different type of sheet material.

The dispenser cabinet described in U.S. Pat. No. 2,969,169 is one attempt to overcome these problems. This dispenser cabinet comprises a housing having a front wall of a plurality of separate semi-cylindrical sections. Each semi-cylindrical section serves as a cover for a separate roll in the housing and is journaled between end walls of the housing on shafts so that it is rotatable into the housing to expose the roll which it would otherwise cover. The rolls are conventionally held within the housing on hubs. A cutter is positioned along the lower edge of each cover section to facilitate cutting of sheet material held on the roll. In use, sheet material is pulled from the housing and, once sufficient is obtained, is pulled upwardly against the cutter to sever it from the rest of the roll. One problem with this dispenser housing is that it is rather large and bulky.

A further dispenser for multiple rolls is described in U.S. Pat. No, 4,557,426. This patent discloses a dispenser for toilet paper comprising an axle rotatably mounted in a housing and a plurality of cantilevered hubs for carrying rolls of sheet material, each attached to the rotary member. The housing has a single opening through which one of the rolls projects. Sheet material may be pulled from this roll until all of it has been used. Then, the system is rotated to move the used roll from the opening and to bring an unused roll into the opening. The dispenser is designed specifically for toilet paper, or other paper provided with tear lines, and thus suffers the disadvantage that it cannot readily be used with sheet material not having tear lines. Moreover, the intention of this dispenser is to provide an uninterrupted supply of one type of paper, rather than selective supply of any of several different types of sheet material.

U.S. Pat. No. 3,132,784 discloses multiple rolls of gift wrap disposed between bosses on end members secured on a common tubular hub by strings which serve as cutting members for the paper. This is a light duty arrangement which may be adequate for easily torn material such as gift wrap. Replenishment of exhausted rolls would be difficult, and it is unsuitable for use with material such as plastic film which are not readily cut by a string.

It is an object of this invention to provide a multiple roll dispenser, for sheet material, which is compact and which is able to dispense sheet material even if not conventionally provided with tear lines, or which are not readily torn.

Accordingly, this invention provides a dispenser for multiple rolls of sheet material and comprises a housing which has a longitudinal axis, a pair of end body portions held in spaced relationship by a plurality of longitudinal bracing members, and a plurality of hubs for retaining the rolls. The hubs are aligned in pairs about the axis and each pair is adapted to receive and rotatably support a roll of sheet material. The dispenser further comprises a semi-cylindrical cover for each pair of hubs with each cover having a cutting edge and bearing means adapted for engaging with the pair of hubs to rotatably support the cover so that the cover is rotatable from an open position in which the pair of hubs are exposed to a closed position covering the pair of hubs. Also, the dispenser comprises a bracket means which rotatably supports the housing. The bracket means and the housing engage manually operable locking means which prevent rotation of the housing in the locked position and allow rotation in the release position.

In use, the covers are rotated to their open positions, a roll of sheet material is positioned between each pair of hubs, and the covers are rotated to their closed positions. To rotate a particular type of sheet material into an accessible position, the locking means are released and after the appropriate sheet is positioned the locking are reengaged preventing rotation of the housing as sheet material is removed.

The invention therefore provides a compact dispenser which is able to carry a multiplicity of rolls of sheet material and which is able to conveniently dispense sheet material which does not have tear lines.

An embodiment of the invention is described, by way of example only, with reference to the drawings in which.

Figure 1:
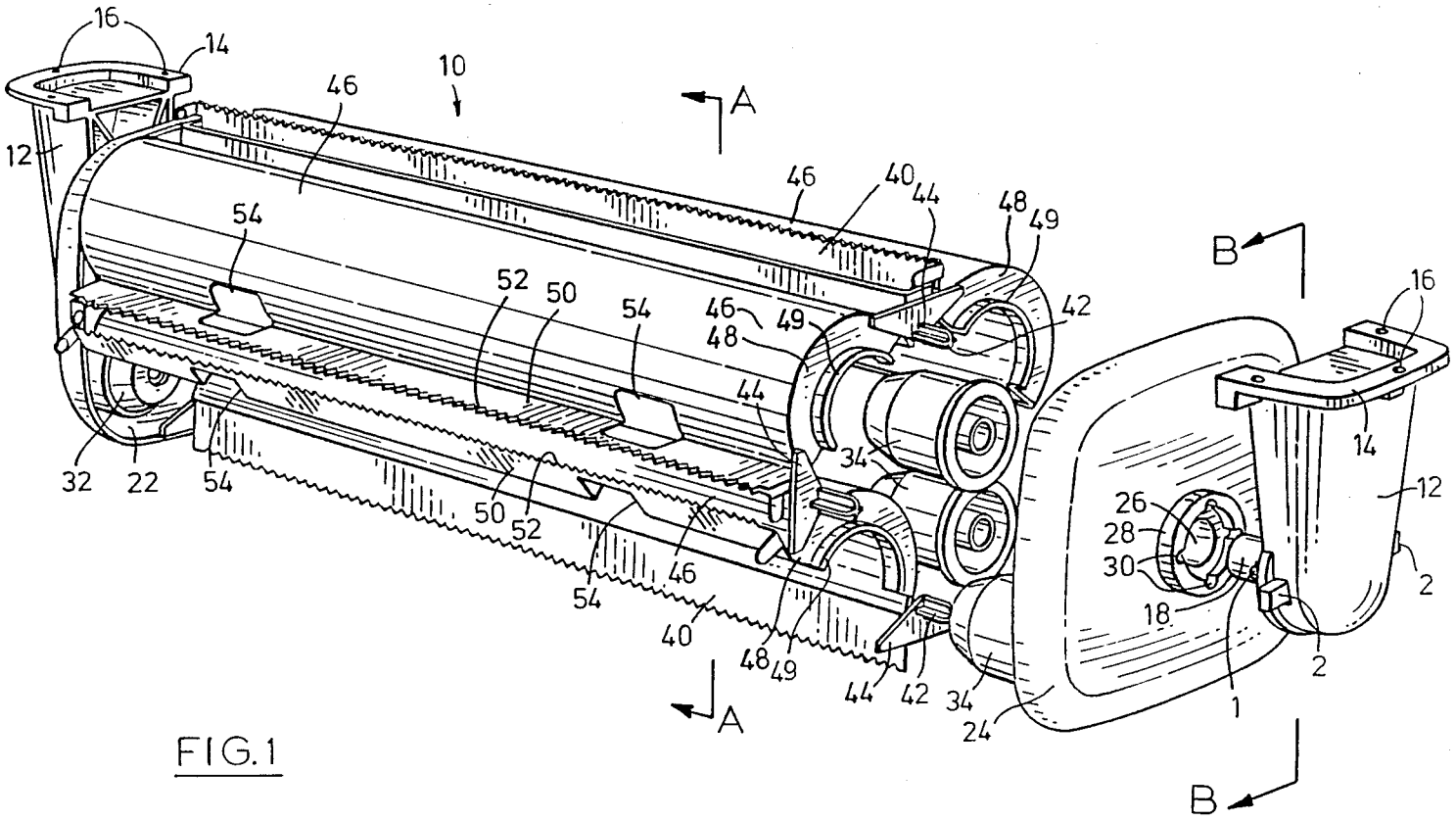
FIG. 1 is a partly exploded perspective view of a multiple roll dispenser.

Referring to FIG. 1, a multiple roll dispenser generally indicated by the numeral 10 is supported by a pair of brackets 12 which are spaced from one another a distance substantially equal to the length of the dispenser 10. Each bracket 12 has a base flange 14 at one end which, in use, is secured to a support surface such as, for example, a wall or underside of a kitchen cupboard, by passing screws (not shown) through the holes 16 provided in each base flange. A short cylindrical axle 18 is provided at the opposite end of each bracket 12. In use, the brackets 12 are mounted so that each axle 18 is aligned along a common longitudinal axis with the axles 18 facing one another.

Referring to FIG. 1 the dispenser 10 comprises a housing structure having a pair of end body portions 22 and 24 which support a plurality of rolls. Each end body portion 22 and 24 is substantially rectangular in plan but with rounded corners. An axial bore 26 is provided in the center of each end body portions 22 and 24 which engages the axle 18 of the bracket 12. The distance from the axial bore 26 to any rounded corner is less than the distance between the axle 18 and the outer face of the flange 14 on any bracket 12 so that the end body portions 22 and 24 may rotate on the axle 18 without engaging the supporting surface. The outer side of each end body portions 22 and 24 is provided with a raised cylindrical projection 28 which has its axis coincident with the axis of the bore 26. The projection 28 has a counter-bore which is larger than the bore 26 and which includes four radial indentations 30 arranged in 90° F. intervals on its inner face.

Figure 4:
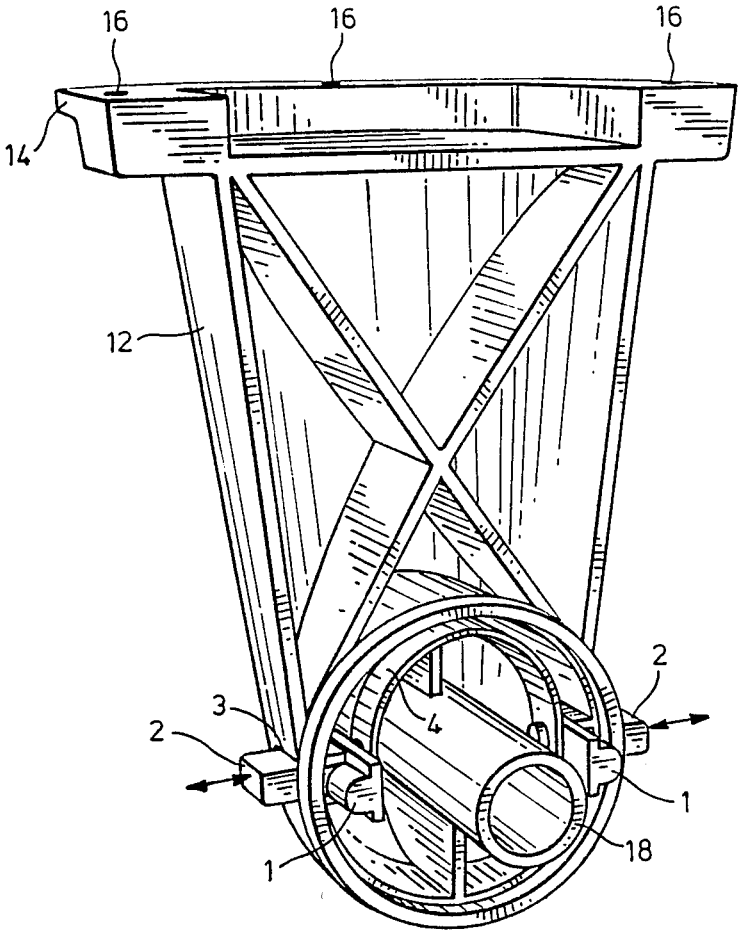
FIG. 4 is a perspective view of an axle and locking means support bracket.

Referring to FIGS. 4 and 1, axle 18 projects inwardly which engages bore 26, and two locking tabs 1 project inwardly engaging indentations 30 in the housing 24. Buttons 2 are attached to the tabs 1 projecting through an opening 3 in the adjacent wall of the bracket 12. Strip spring 4 spans arcuately between both opposing tabs 1 and biases the tabs 1 outwardly to engage opposing indentations 30. To release the locking tabs 1 both are depressed using one hand squeezing both sides of the bracket 12 simultaneously, the housing is rotated to access the desired roll, and then the tabs 1 are released thereby locking the housing in position for removal of material. In order to minimize production costs both brackets 12 are manufactured with knock-out sections in the bracket walls to form openings 3 to accommodate the buttons 2. During assembly however only one bracket 12 has locking means installed, and the knock-out sections of the other bracket 12 are left intact.

Figure 3:
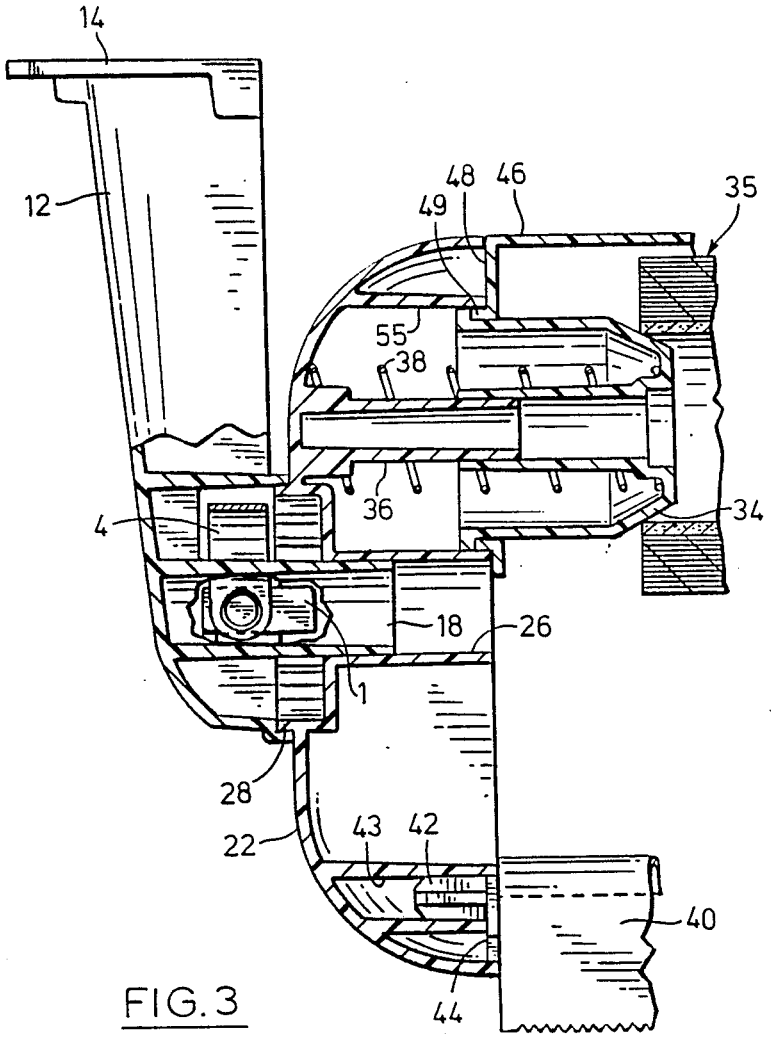
FIG. 3 is a part sectional view along line B—B of FIG. 1.

As shown in FIG. 1, one end body portion 22 has four fixed hubs 32 one positioned adjacent each corner. The fixed hub 32 is cylindrical in shape with an inwardly tapered distal end as is conventional. The opposite end body portion 24, also includes a similar hub 34 adjacent each corner but, as best illustrated in FIG. 3, the hubs 34 slide on cylindrical projections 36 which extend from the inner face of the end body portion 24 and on the inner surface of a spool 55. A spring 38 extends about each cylindrical projection 36 and into the hub 34 and hence biases the hub 34 away from the end body portion 24. In use, one end of the bore of a roll of sheet material (not shown) is pushed on a biased hub 34 inwardly toward the end body portion 24, the opposite end of the roll is aligned with the hub 32, and the hub 34 and engaged roll are released to engage in the opposite end of the bore of the roll on hub 32. The engagement of any pair of hubs 32 and 34 with a roll is conventional.

Figure 2:
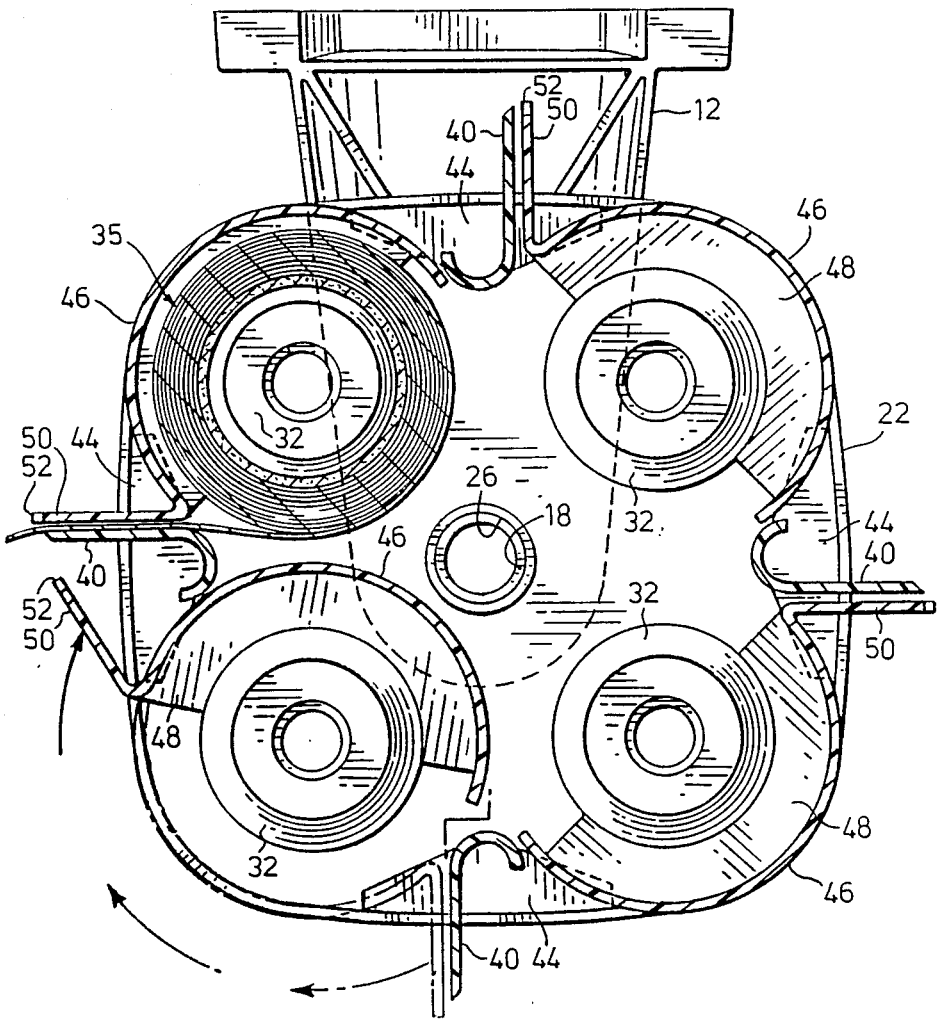
FIG. 2 is a section taken along A—A of FIG. 1.

Referring to FIGS. 1, 2 and 3, four bracing members 40 extend between the end body portions 22 and 24 one adjacent the center of each edge of the end body portions 22 and 24. As shown in FIG. 3 each end of each bracing member 40 includes a stud 42 which engages into a correspondingly shaped recess 43 in each end body portion 22 and 24. As shown in FIG. 1 a small triangular retaining flange 44 is mounted between the bracing member 40 and each stud 42. A semi-cylindrical cover 46, which has edge flanges 48 and bearings 49, each shaped to engage about hubs 32 and 34, is provided between each bracing member 40. As shown in FIG. 3 each cover 46 may rotate with bearings 49 running between hubs 32 and 34 and the inner surface of spool 55. Each cover 46 further includes an edge flange 50 directed radially outwardly of the dispenser and having a serrated edge 52. Slots 54 are cut into each cover 46 adjacent the edge flange 50. As shown in FIG. 2 in use each cover 46 is rotated clockwise on the hubs 32 and 34 to expose the hubs 32 and 34. A roll of sheet material is then positioned on the hubs 32 and 34 as is conventional. The cover 46 is then rotated counter clockwise to entirely cover the roll of sheet material apart from small portions which may be seen through the slots 54 and the leading edge of the sheet which projects from the flange 50. To extract some sheet material from the dispenser, the leading edge of the sheet material is pulled outwardly and, once sufficient sheet material is obtained, the sheet material is pulled upwardly against the serrated cutting edge 52 and torn off as is conventional. If however another type of sheet material is required, the user merely unlocks and rotates the dispenser until the roll containing that sheet material is conveniently accessible.

The apparatus can be conveniently manufactured by molding from any suitable structural plastic and is therefore inexpensive to manufacture. Furthermore the unit is compact and allows sheets which are not normally provided with tear lines to readily dispensed.

It will be appreciated that many variations may be made to the embodiment without departing from the scope of the invention as set out in the claims.

The embodiments of the invention in which and exclusive property or privilege is claimed are defined as follows:

1. A dispenser for multiple rolls of sheet material, the dispenser comprising:

a housing having a longitudinal axis, a pair of end body portions held in spaced relationship by a plurality of longitudinal bracing members, and a plurality of hubs for retaining the rolls, the hubs aligned in pairs about the axis and each pair adapted to receive and rotatably support a roll of sheet material;

a semi-cylindrical cover for each pair of hubs, each cover having a cutting edge and having bearing means adapted for engaging with the pair of hubs to rotatably support the cover so that the cover is rotatable from an open position in which the pair of hubs are exposed to a closed position covering the pair of hubs;

a bracket means rotatably supporting the housing;

manually operable locking means engaging the housing and bracket means preventing rotation of the housing in the locked position and allowing rotation in the release position;

wherein the manually operable locking means comprises a plurality of indentations radially spaced about the longitudinal axis of the housing, and outwardly spring loaded locking tabs projecting from the bracket means adapted to engage the indentations, said locking tabs each having buttons which when manually depressed release said locking tabs from said indentations.

2. A dispenser according to claim 1 in which each of the pair of end body portions has an axial bore for receiving an axle means projecting from the bracket means.

3. A dispenser according to claim 2 in which each end body portion includes a counter bore having a gear surface on its inner face.

4. A dispenser according to claim 1 or 2 in which one hub of each pair includes biasing means.

5. A dispenser according to claim 1 in which each cover has a pair of radially inwardly directed edge flanges, each flange supporting a bearing surface adapted to engage a hub.

6. A dispenser according to claim 1 in which each cover has slots through it.

7. A dispenser according to claim 1 in which the bracket means comprises a pair of brackets, each bracket adapted to engage an opposite end body portion of the housing to the other bracket.

8. A dispenser according to claim 7 in which each bracket has an axle and each end body portion has an axial bore receiving the axle of the bracket engaging it.

9. A dispenser according to claim 7 in which the manually operable locking means comprises a plurality of indentations radially spaced about the longitudinal axis of the housing, and outwardly spring loaded locking tabs projecting from the bracket means adapted to engage the indentations, said locking tabs each having buttons which when manually depressed release said locking tabs from said indentations.

10. A dispenser according to claim 1 in which the manually operable locking means comprises a plurality of indentations radially spaced about the longitudinal axis of the housing, and outwardly spring loaded locking tabs projecting from the bracket means adapted to engage the indentations, said locking tabs each having buttons which when manually depressed release said locking tabs from said indentations.

* * * * *